US006196661B1

(12) United States Patent
Saito

(10) Patent No.: US 6,196,661 B1
(45) Date of Patent: Mar. 6, 2001

(54) SERIAL RECORDING APPARATUS

(75) Inventor: Tetsuya Saito, Fukushima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/361,153

(22) Filed: Jul. 27, 1999

(30) Foreign Application Priority Data

Jul. 30, 1998 (JP) ..... 10-215689

(51) Int. Cl.[7] ..... B41J 23/00

(52) U.S. Cl. ..... 347/37; 347/36; 347/16; 347/234; 400/76; 400/323; 400/283; 400/708; 400/903

(58) Field of Search ..... 347/37, 234, 16, 347/36; 400/76, 323, 708, 903, 283

(56) References Cited

U.S. PATENT DOCUMENTS 4,203,678 * 5/1980 Nordstrom et al. ..... 400/320
4,311,399 * 1/1982 Wegryn et al. ..... 400/73
4,460,968 * 7/1984 Cavill et al. ..... 364/519
4,915,525 * 4/1990 Hosoi ..... 400/583
5,524,995 * 6/1996 Brookner et al. ..... 400/596
5,561,449 * 10/1996 Raskin et al. ..... 347/37
5,639,171 * 6/1997 Brewster, Jr. et al. ..... 400/708
6,049,348 * 4/2000 Spurr ..... 347/234

* cited by examiner

*Primary Examiner*—John Barlow
*Assistant Examiner*—Cesar G. Lago
(74) *Attorney, Agent, or Firm*—Fitzpatrick, Cella, Harper & Scinto

(57) ABSTRACT

It is intended to expand the recording width of the serial printer by executing the one-directional recording, instead of the two-directional recording, according to the required recording width. For this purpose there is provided a serial recording apparatus comprising a carrier for mounting a recording head for executing recording on a recording medium, a scanning section for causing the carrier to execute a reciprocating scanning motion along the recording medium and a recording section for executing the recording in the scanning motions in two directions of the carrier in case the recording width required for the recording along the scanning direction of the carrier does not exceed a predetermined reference recordable width, and executing the recording in the scanning motion of the carrier in one direction only in case the required recording width is larger than the predetermined reference recordable width.

7 Claims, 6 Drawing Sheets

SERIAL RECORDING APPARATUS

BACKGROUND OF THE INVENTION

1. Field of the Invention

The present invention relates to a serial recording apparatus equipped with a carrier for causing a recording head to execute a scanning motion relative to a recording medium, and more particularly to the driving of the carrier in the recording apparatus capable of recording both in the forward and reverse directions.

2. Related Background Art

Among serial printers for executing recording operation by driving a recording head mounted on a carrier while moving the carrier along a recording sheet, there is already known a serial printer capable of recording both in the forward and reverse motions of the carrier in order to increase the recording speed.

As a representative example of such serial printer, there is widely known an ink jet serial printer effecting the recording operation by discharging ink from a recording head onto a recording sheet.

FIG. 2 is a schematic view showing the configuration of a serial printer of the ink jet method. A carrier 1 is supported by a guide shaft 2 and a guide rail 4 so as to be capable of reciprocating motion relative to an LF (line feed) roller 5 and a platen 6 supported by a chassis 3. A recording head 7 is mounted on the carrier 1, and executes reciprocating motion along the guide shaft 2, by the power of a carrier motor 8 transmitted by a belt 9.

A recording sheet 10 is supported in the printer by being held between the LF roller 5 and a pinch roller 11, and is transported perpendicularly to the axis of the LF roller 5 by the frictional force by the rotation of the LF roller 5.

In the recording operation, the carrier motor 8 is driven with an acceleration table of a predetermined number of steps to shift the carrier 1 from the stopped state to an acceleration state. Thereafter the carrier motor 8 is driven with a predetermined driving frequency, whereby the carrier 1 moves at a constant speed. In this state the recording head 7 is driven according to recording data transferred to the printer, thereby discharging ink toward the recording sheet 10. After the driving of the recording head 7 for a line, the carrier motor 8 is driven with a deceleration table of a predetermined number of steps to decelerate the carrier 1, eventually bringing it to a stopped state.

Also after the recording of a line, the LF roller 5 is rotated by a predetermined amount to transport the recording sheet 10 in such a manner that a portion thereof to be recorded next is brought to a position opposed to the recording head 7. After this operation, the carrier motor 8 is driven again to move the carrier 1 and the recording head 7 is driven again during the motion of the carrier 1 to record the next line. When all the recording data are recorded by the repetition of the above-described operations, the recording sheet 10 is discharged by a discharge roller 12 to the exterior of the printer, whereupon the recording operation is completed.

In the printer of the above-described configuration, if the recording operation is executed only in one moving direction in the motion of the carrier 1, there is required a returning operation for returning the carrier to the start position after the recording of each line, thus resulting in a significant loss in increasing the recording speed.

For this reason, high-speed recording is generally achieved by eliminating such loss in time, by so-called two-directional recording in which the recording is executed both in the forward and reverse motion of the carrier 1.

FIGS. 3A and 3B show the concept of carrier drive in the conventional two-directional recording. In the recording operation while the carrier 1 is driven in a direction from right to left in FIG. 2 (hereinafter called forward direction), the carrier motor 8 is driven with an acceleration table AC1 and a deceleration table DC1 as shown in FIG. 3A, whereby the carrier is moved in the forward direction. In case of carrier movement in a direction from left to right (hereinafter called reverse direction), the carrier motor 8 is driven with an acceleration table AC2 and a deceleration table DC2 as shown in FIG. 3B, whereby the carrier is moved in the reverse direction.

As the frictional force generated between the carrier 1 and the guide shaft 2 or the guide rail 4 functions as a braking force, the deceleration is generally achieved with a fewer number of steps or with a shorter moving distance than in the acceleration. Therefore, the number NAC1 of driving steps for the carrier motor 8 at the acceleration and the number NDC1 of driving steps at the deceleration satisfy a relationship NAC1>NDC1. Similarly at the recording operation in the reverse direction, there stands a relationship NAC2>NDC2 between the number NAC2 of driving steps for the carrier motor 8 at the acceleration and the number NDC2 of driving steps at the deceleration. In FIGS. 3A and 3B, SC1 and SC2 indicate printing ranges.

However, in the two-directional recording, in order to record in a same recording range both in the forward recording and in the reverse recording, it is necessary to employ a same number of driving steps for the acceleration and for the deceleration, thereby realizing a same moving distance of the carrier in the acceleration and in the deceleration.

For this reason, in the recording in the forward direction, the deceleration is started after a movement by a predetermined distance ΔS, whereby the movement amount SAC1 of the carrier 1 in the acceleration is made equal to the movement amount SDC1' of the carrier 1 from the end of recording to the stopping of the carrier 1. Similarly, in the recording in the reverse direction, the deceleration is started after a movement by a predetermined distance ΔS, whereby the movement amount SAC2 of the carrier 1 in the acceleration is made equal to the movement amount SDC2' of the carrier 1 from the end of recording to the stopping of the carrier 1. The distance AS is defined by ΔS=SAC1−SDC1=SAC2−SDC2.

Therefore, for a given movable range S1 of the carrier 1, the recordable range becomes narrower by ΔS in comparison with the one-directional recording.

In summary, in the conventional serial printer capable of two-directional recording, the recording range is defined by the mutually overlapping area of the recordable range in the forward direction and that in the reverse direction, and the moving range of the carrier has to be made wider in order to expand the recordable range. Consequently, the width of the printer has to be made considerably larger than the minimum necessary width of the printer required for the recordable range, and such configuration is disadvantageous in dimension and cost of the printer.

As explained in the foregoing, in the conventional serial printer capable of two-directional recording, the moving distance of the carrier 1 from the end of recording to the stopping of the carrier 1 is selected equal to the moving distance at the acceleration, and thus larger than the minimum necessary moving distance, so that the width of the printer becomes large in relation to the recording range.

SUMMARY OF THE INVENTION

In consideration of the foregoing, the object of the present invention is to provide a serial printer with a carrier driving method capable of expanding the recording range without increasing the basic width of the printer.

The above-mentioned object can be attained, according to the present invention, by a serial recording apparatus comprising a carrier for mounting a recording head for executing recording on a recording medium, means for causing the carrier to execute a reciprocating scanning motion along the recording medium, and means for executing the recording in the scanning motions in two directions of the carrier in case the recording width required for the recording along the scanning direction of the carrier does not exceed a predetermined reference recordable width, and executing the recording in the scanning motion of the carrier in one direction only in case the required recording width is larger than the predetermined reference recordable width, or by a serial recording apparatus comprising a carrier for mounting a recording head for executing recording on a recording medium, means for causing the carrier to execute a reciprocating scanning motion along the recording medium, and means for executing the recording in the scanning motions in two directions of the carrier in case of recording on a recording medium of a size not exceeding a reference size of a reference recording medium, and executing the recording in the scanning motion of the carrier in one direction only in case of recording on a recording medium of a size larger than the reference size.

Thus, if the recording range does not exceed the predetermined recording range (reference recording width) corresponding to a frequently used sheet (reference recording medium), the recording is executed in the forward and reverse scanning motions to achieve the maximum speed, but, if the recording range is larger than the reference recording range, the recording is executed in the scanning motion of one direction only to expand the recordable range in comparison with that in the two-directional recording, whereby the recordable range can be maximized without unnecessarily increasing the width of the printer itself and with an improvement in the recording speed.

DESCRIPTION OF THE PREFERRED EMBODIMENTS

Now the present invention will be clarified in detail with reference to the attached drawings.

In the present invention, the term "recording" includes not only providing a recording medium with a meaningful image such as a character or graphics but also providing the recording medium with a meaningless image such as a pattern.

Also the present invention is applicable to a recording apparatus for recording on various recording media such as paper, yarn, fiber, fabrics, leather, metals, plastics, glass, timber or ceramics; an apparatus such as a copying apparatus, a facsimile apparatus having a communication system or a word processor having a recording unit; and an industrial recording apparatus combined with various processing units.

First Embodiment

Figure 1A:
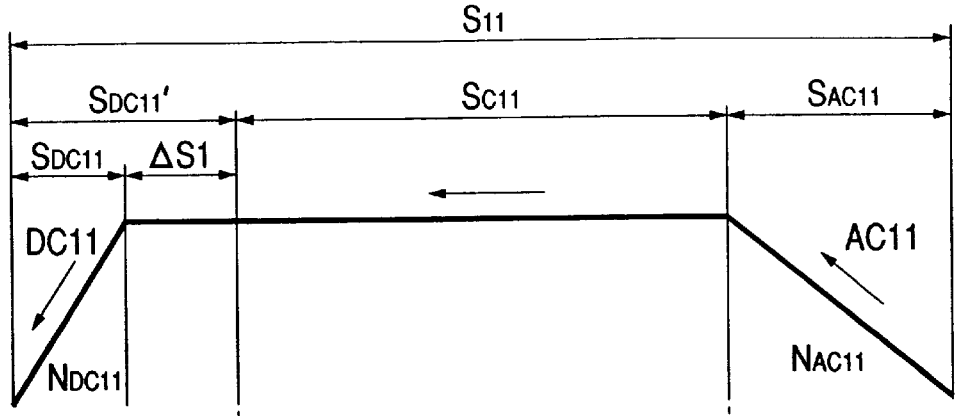
FIGS. 1A, 1B and 1C are schematic charts showing the function of the carrier in a first embodiment of the present invention.
Figure 1B:
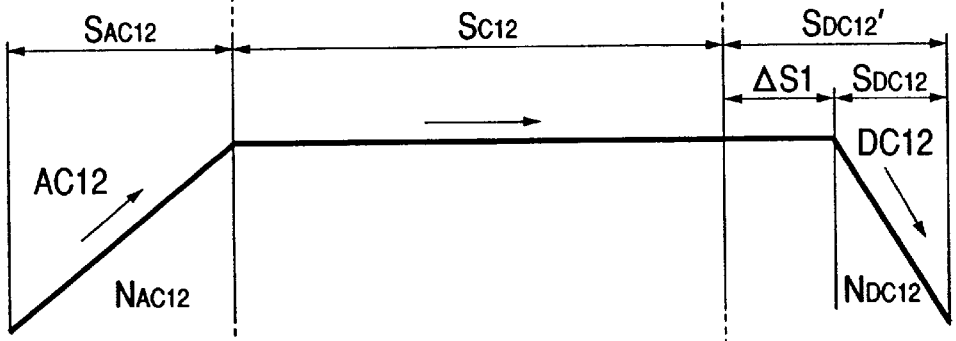
Figure 1C:
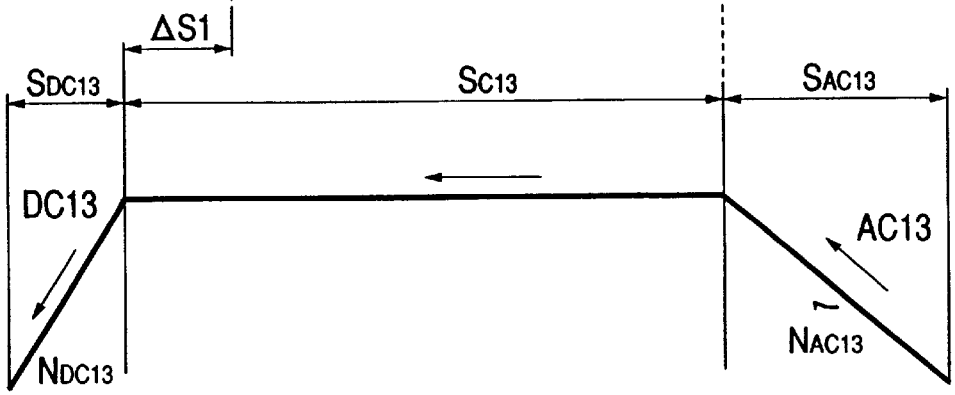
Figure 2:
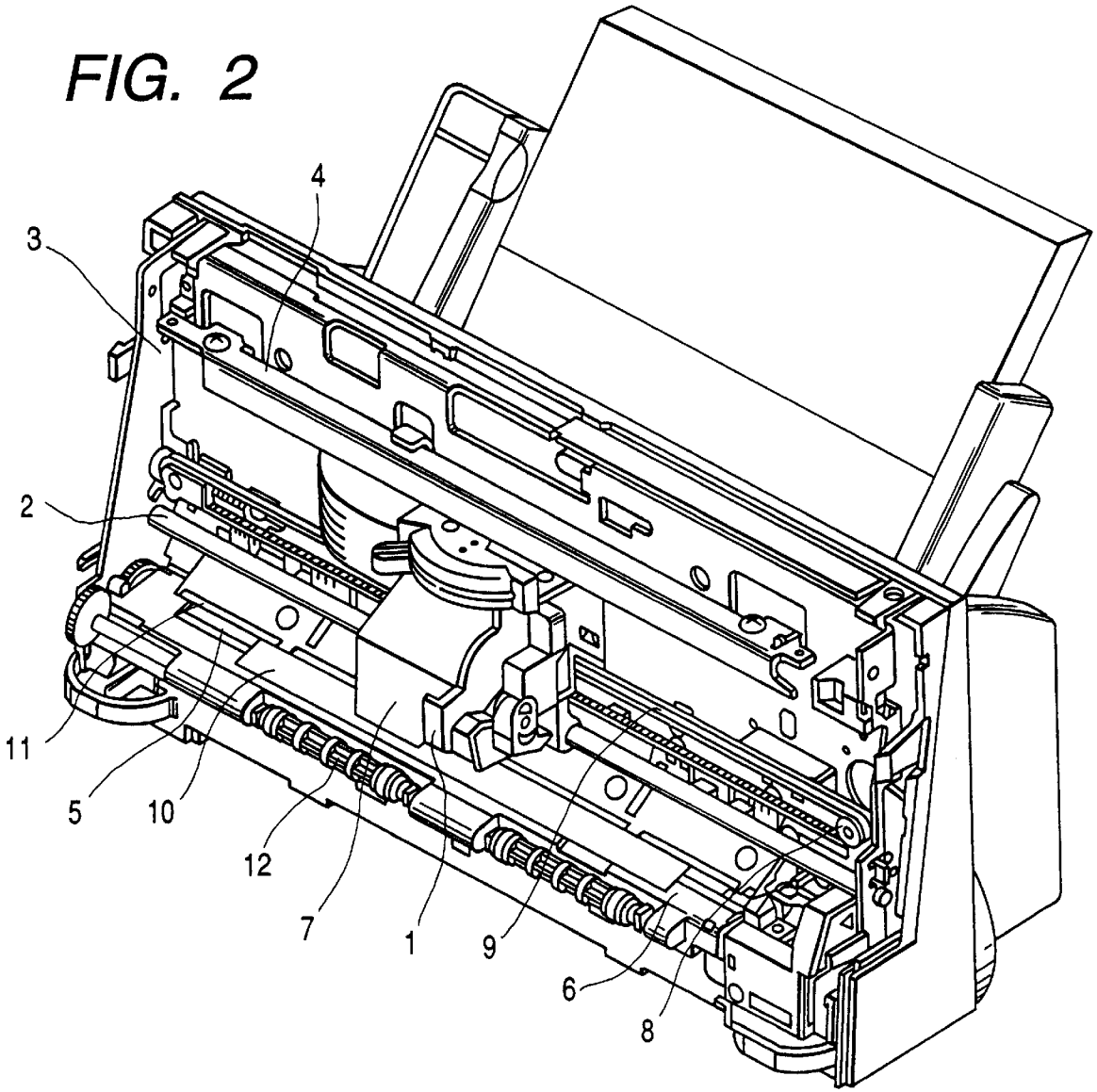
FIG. 2 is a schematic view of a serial printer of the ink jet type.

FIGS. 1A to 1C show the concept of a carrier driving method based on the present invention. In this embodiment explained is a recording apparatus corresponding to an A4-sized recording sheet (width 210 mm) as a reference recording medium of the reference size.

FIGS. 1A and 1B show the driving of the carrier in recording on the A4-sized recording sheet in the forward and reverse directions, respectively. In the drawings, a horizontal axis indicates a position of the carrier in the recording apparatus, and a vertical axis indicates a movement speed of the carrier.

As in the conventional configuration, in case of recording in the forward direction, a carrier motor 8 consisting of a stepping motor and serving to move a carrier 1 is driven, as shown in FIG. 1A, according to an acceleration table AC11 and a deceleration table DC11 to move the carrier 1 in the forward direction. Also in case of recording in the reverse direction, the carrier motor 8 is driven, as shown in FIG. 1B, according to an acceleration table AC12 and a deceleration table DC12 to move the carrier 1 in the reverse direction. In FIGS. 1A to 1C, SC11, SC12 and SC13 indicate recording ranges.

Among the number NDC11 of driving steps for the carrier motor 8 in the deceleration table DC11, the number NAC12 of driving steps for the carrier motor 8 in the acceleration table AC12, the number NDC12 of driving steps in the deceleration table DC12 and the number NAC11 of driving steps in the acceleration table AC11, there stands the following relationship:

$$NAC11=NAC12>NDC11=NDC12.$$

However, in order to obtain a same recording range (recording width) in both recording directions in the two-directional recording, it is necessary, as in the conventional configuration, to move the carrier 1 by a distance ΔS from the end of recording to the start of deceleration, thereby attaining a relationship:

$$SAC11=SDC11'=SAC12=SDC12'$$

Figure 3A:
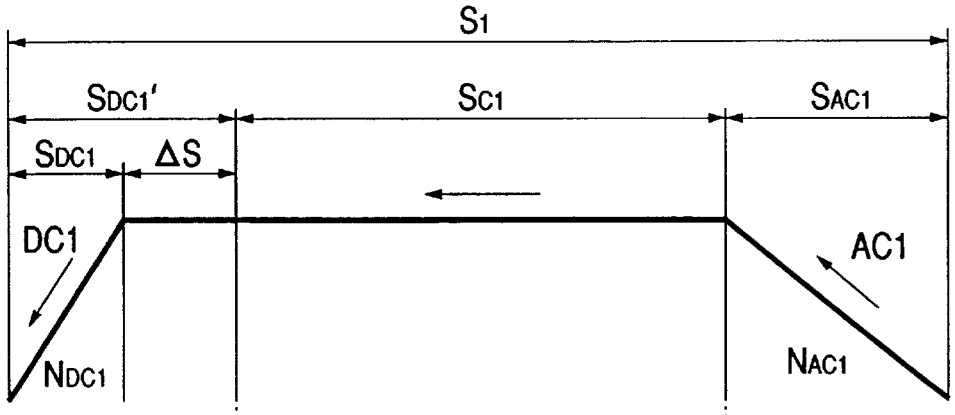
FIGS. 3A and 3B are schematic charts showing the function of the carrier in a conventional configuration.
Figure 3B:
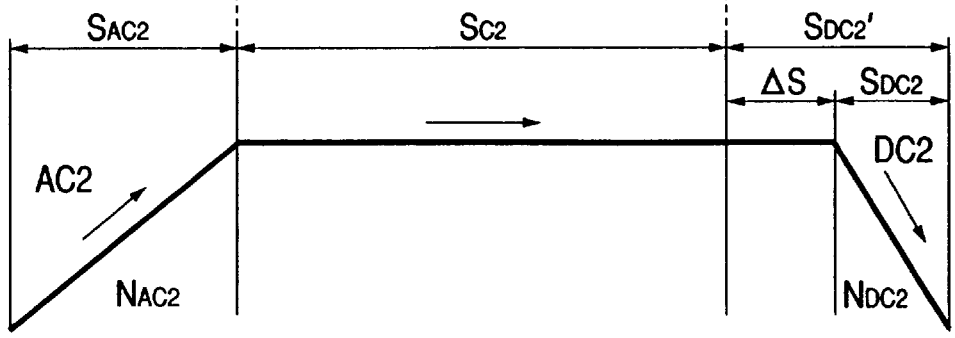

(two meanings of these signs are the same as those in FIGS. 3A and 3B).

Consequently, the width of the printer itself is determined from a carrier moving distance S1 which is the sum of the recording range (reference recording width) SC11 corresponding to the recording sheet of reference size (A4-size in the present embodiment) and SAC11 and SDC11'.

In the printer of the present invention, in case the recording range required for actual recording (necessary recording width) is selected larger than the reference recording width determined for the case of two-directional recording on the recording medium of reference size, there can be executed the one-directional recording by the carrier driving method shown in FIG. 1C. Thus, in the present invention, the two-directional or one-directional recording is selected according to the recording range required for recording.

As the number NDC13 of the driving steps in the deceleration table DC13 is selected as the minimum necessary number for stopping the carrier, it is smaller than NDC11 in the two-directional recording. Accordingly, the moving distance at the deceleration is shorter by ΔS1 (=SDC11−SDC13) than in the two-directional recording. Consequently, for a given total moving distance S11 of the carrier 1, the range of constant-speed motion of the carrier 1 becomes larger than in the two-directional recording and the recordable range is expanded by ΔS1. Therefore, the printer designed for A4 size can print the recording sheet of a width up to 210 mm+ΔS at maximum.

Second Embodiment

In the following there will be explained an embodiment in case the necessary recording width of the recording sheet 10, required for actual recording, is somehow identified in advance for each kind (for example A4 size or B4 size) of the sheet. Also in this embodiment there will be explained a case where the A4-sized recording sheet (width 210 mm) is taken as the reference recording medium.

Figure 4:
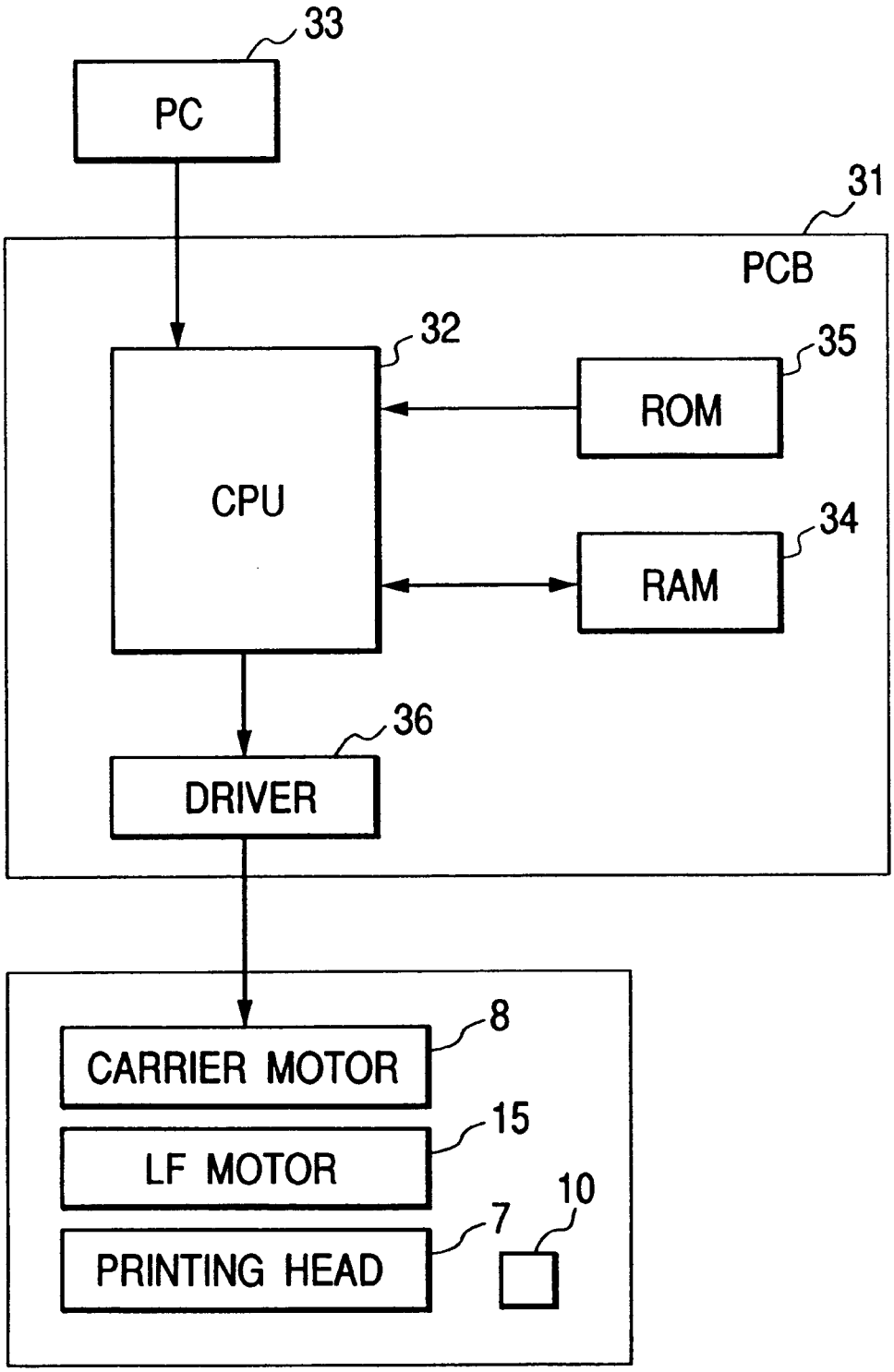
FIG. 4 is a block diagram showing the configuration of a second embodiment of the present invention.

FIG. 4 is a block diagram showing the configuration of the printer. A printed circuit board (PCB) 31 is provided with a CPU 32 for information processing, a RAM 34 for storing the recording data transferred from a personal computer (PC) 33 constituting a host equipment, a ROM 35 storing tables for driving the carrier motor 8 of the printer unit, and a driver 36 for outputting signals for driving the carrier motor 8 according to such tables.

Before transferring the recording data into the printer, the PC 33 sends information on the recording sheet to the CPU 32, which, on the basis of the information, extracts the driving table for the carrier motor 8 and the driving table for the recording head 7 from the ROM 35 and controls the drivers 36, 37 for driving the carrier motor 8 and the recording head 7.

Figure 5A:
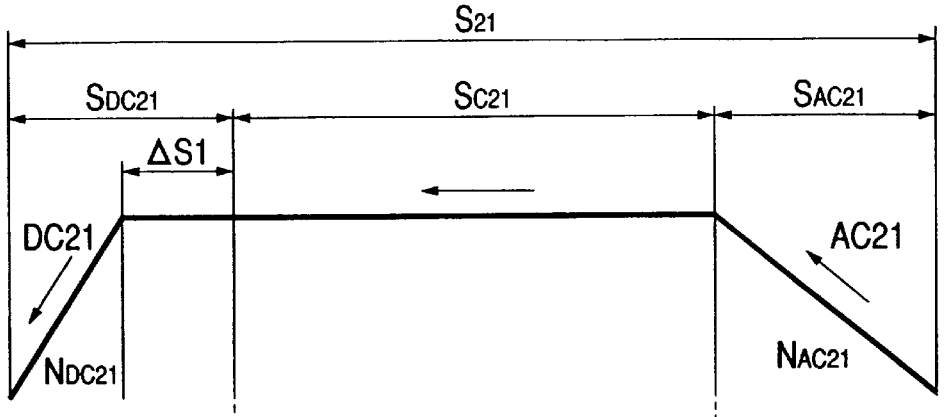
FIGS. 5A, 5B and 5C are schematic charts showing the function of the carrier in the second embodiment of the present invention.
Figure 5B:
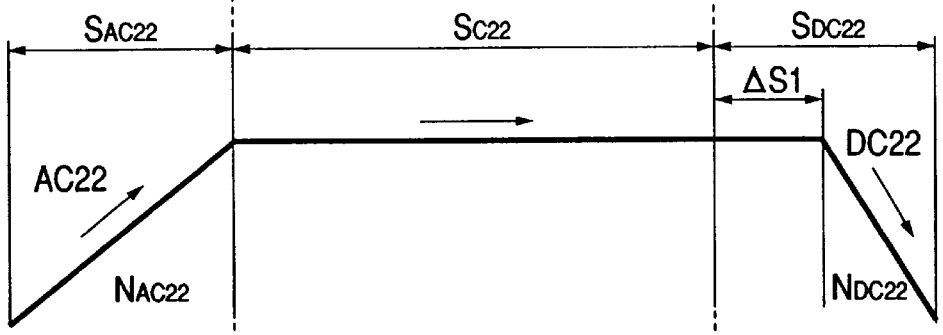
Figure 5C:
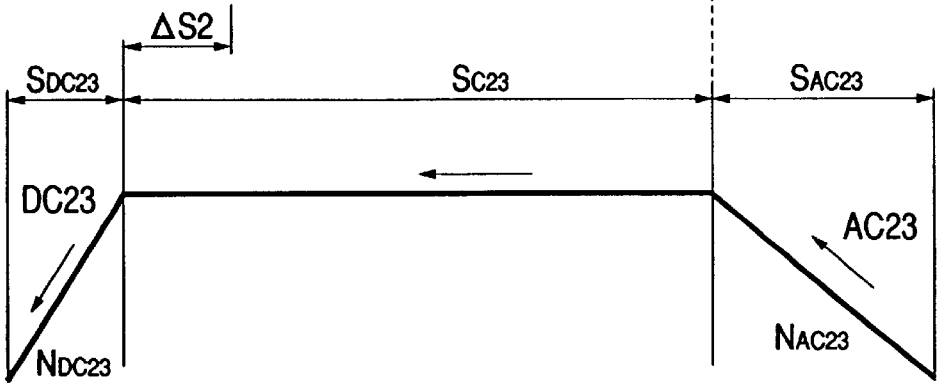

FIGS. 5A to 5C show the concept of the carrier driving method for the printer of the above-described configuration.

In case an A4-sized recording sheet is selected for actual recording, the two-directional recording is executed as in the conventional configuration, and, in the recording operation in the forward direction, the carrier motor 8 is driven by an acceleration table AC21 and a deceleration table DC21 to move the carrier in the forward direction. In the recording operation in the reverse direction, the carrier motor 8 is driven by an acceleration table AC22 and a deceleration table DC22 to move the carrier in the reverse direction.

Among the number NDC21 of driving steps for the carrier motor 8 in the deceleration table DC21, the number NAC22 of driving steps for the carrier motor 8 in the acceleration table AC22, the number NDC22 of driving steps in the deceleration table DC22 and the number NAC21 of driving steps in the acceleration table AC21, there stands the following relationship:

$$NAC21=NAC22>NDC21=NDC22.$$

However, in order to obtain a same recording range in both recording directions in the two-directional recording, it is necessary, as in the conventional configuration, to move the carrier 1 by a distance ΔS1 from the end of recording to the start of deceleration, thereby attaining a relationship:

$$SAC21=SDC21'=SAC22=SDC22'.$$

In such state, the reference recording width that can be recorded in the two-directional scanning becomes SC21. Therefore, the total moving amount of the carrier 1 becomes S21, on which the width of the printer itself is determined.

Also in the printer of the present embodiment, in case the size of the recording sheet is for example B4 and is selected larger than the reference A4 size, there can be executed, as in the foregoing embodiment, the one-directional recording by the carrier driving method shown in FIG. 1C.

As the number NDC23 of the driving steps in the deceleration table DC2 is selected as the minimum necessary number for stopping the carrier, it is smaller than NDC21 in the two-directional recording. Accordingly, the moving distance at the deceleration is shorter by ΔS2 (=SDC21−SDC23) than in the two-directional recording. Consequently, for a given total moving distance of the carrier 1, the range of constant-speed motion of the carrier 1 becomes larger than in the two-directional recording and the recordable range is expanded by ΔS2. Therefore, the printer designed for A4 size can print a recording sheet larger than A4 size.

In the present embodiment, even when the recording sheet for recording is selected larger than the A4-sized reference recording sheet, the two-directional recording is executed if the recording data of a line do not contain data to be recorded outside the reference recording width in the A4 size, and the one-directional recording is executed only if the recording data of a line contain data to be recorded outside the reference recording width in the A4 size (namely the range required for recording is longer). In this manner it is possible to maximize the recording speed in case of recording on a recording sheet larger than the reference A4 size.

Figure 6:
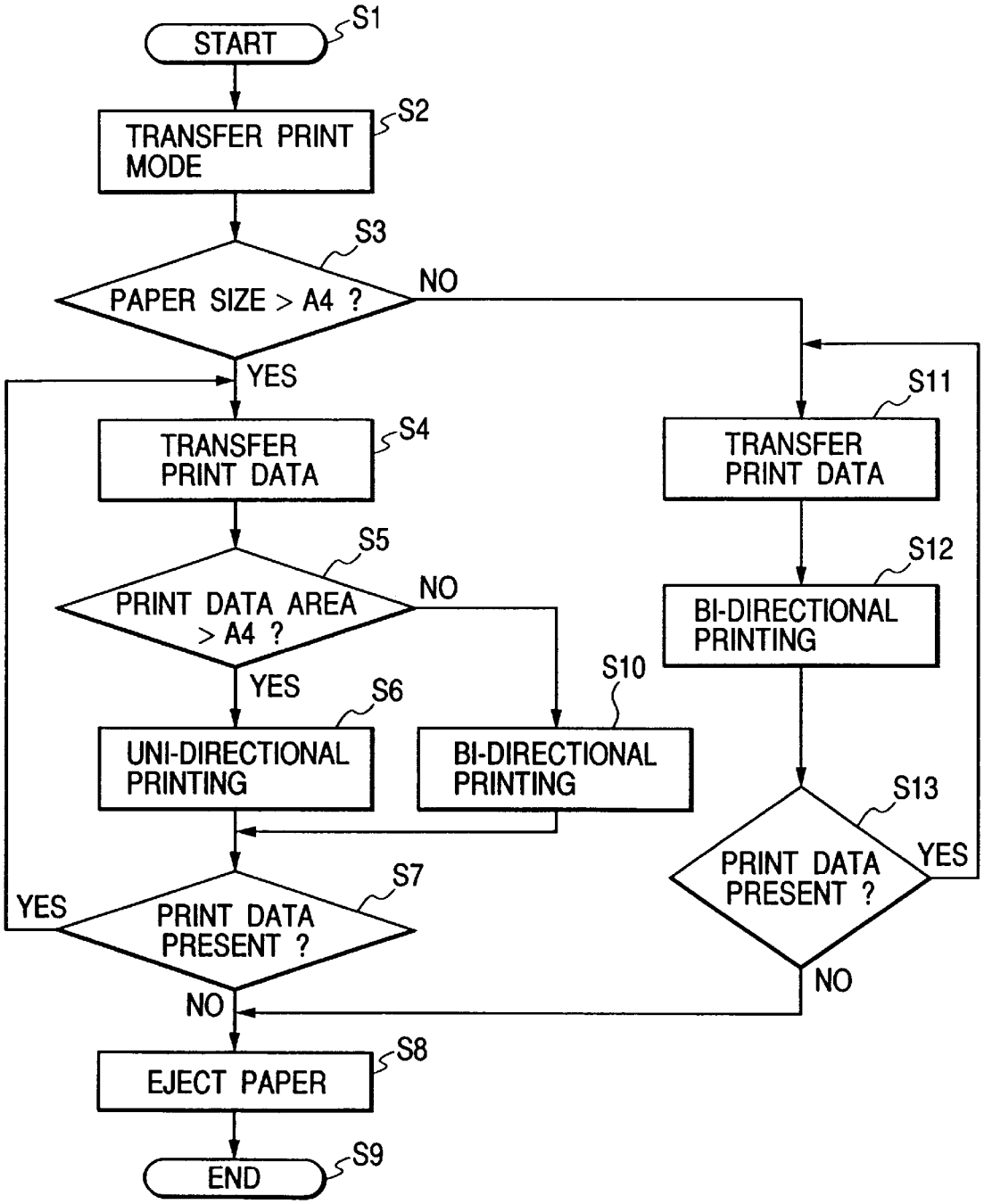
FIG. 6 is a flow chart showing the control sequence for the carrier drive in the recording operation in a second conventional configuration.

FIG. 6 is a flow chart showing the control sequence of the present embodiment. In case of starting the recording operation with the recording data transferred from the PC 33, there is at first transferred to the CPU 32 setting information such as the size of the recording sheet (see steps S1 and S2). If a step S3 identifies that the size of the recording sheet exceeds the reference A4 size, the sequence proceeds to a step S4 for transferring the recording data. Then there is discriminated whether the recording data are present outside the maximum recording width in the A4 size, and, if present, the sequence proceeds to a step S6 to execute recording by the one-directional recording. If absent, the recording can be achieved with recording method same as that for the A4 size, and the sequence proceeds to a step S10 to execute two-directional recording.

After recording of a line, a step S7 discriminates whether the remaining recording data are still present, and, if present, the sequence returns to the step S4 for continuing the recording operation, but, if absent, the sequence proceeds to a step S8 to discharge the recording sheet thereby terminating the sequence.

In case the step S3 identifies that the size of the recording sheet does not exceed A4 size, the two-directional recording is possible for all the data. Therefore, the two-directional recording is executed, and, after the recording, the recording sheet is discharged to terminate the sequence.

Through the above-described operations, the two-directional recording is executed for a recording sheet not exceeding A4 size, and, for a recording sheet exceeding A4 size, the two-directional recording is executed for a line not requiring the one-directional recording and the one-directional recording is executed only for the necessary recording lines. It is, therefore, possible to minimize the loss in time resulting from the one-directional recording and to maximize the recording speed in case of recording on the recording sheet exceeding A4 size.

In the foregoing embodiments, the A4-sized sheet is selected as the recording medium of reference size, but such selection is naturally not restrictive. For example, the recording medium of B5, A5, B4 or A3 size may be similarly selected as the reference recording medium.

The comparison of the recording width required for recording on the recording sheet (necessary recording width) and the reference recording width may be conducted in the following manner.

The comparison of the necessary recording width and the reference recording width may be executed in the host computer PC 33 itself for example by the identification of the kind of the recording sheet by the user, and the result of such comparison may be given to the printer to designate the one- or two-direction recording explained above.

Otherwise the printer may be provided with a sensor 10 for detecting the necessary recording width of the recording sheet to be used for recording and the CPU 32 may compare the detected value with the reference recording width stored in a memory in the printer to designate the one- or two-directional recording. Also it is possible to execute the comparison in the host computer by transferring the detected value thereto and to operate the printer according to the result of the comparison.

The above-mentioned sensor for detecting the necessary recording width of the recording sheet may be composed for example of an optical sensor or a mechanical sensor utilizing a level actuated by the impingement of the recording sheet. Such sensor may be provided in the transporting path for the recording sheet, or, in case of an optical sensor, it may be provided on a carriage for moving the recording head.

The present invention is applicable to the bubble jet recording method in which a heat generating member provided in a liquid path is activated to give heat to ink thereby inducing film boiling and causing ink discharge from an orifice, the ink jet recording method in which a piezoelectric element provided in a liquid path is driven to discharge ink from an orifice, or the thermal recording method in which a heat generating member generates heat to transfer ink onto the recording sheet or to cause color formation in a heat-sensitive recording paper.

As explained in the foregoing, the two-directional recording is executed in case the recording range (necessary recording width) required for recording does not exceed a predetermined recording range (reference recording width) but the one-directional recording is executed in case the necessary recording width exceeds the reference recording width, whereby it is rendered possible to execute the recording in a wider recording range without expanding the basic width of the printer and with an improved recording speed.

What is claimed is:

1. A serial recording apparatus comprising:

a carrier for mounting a recording head for executing recording on a recording medium;

means for causing said carrier to execute a reciprocating scanning motion along said recording medium; and means for executing the recording in the scanning motions in two directions of said carrier in case the recording width required for the recording along the scanning direction of said carrier does not exceed a predetermined reference recordable width, and executing the recording in the scanning motion of said carrier in one direction only in case the required recording width is larger than said predetermined reference recordable width.

2. A serial recording apparatus comprising:

a carrier for mounting a recording head for executing recording on a recording medium;

means for causing said carrier to execute a reciprocating scanning motion along said recording medium; and means for executing the recording in the scanning motions in two directions of the carrier in case of recording on a recording medium of a size not exceeding a reference size of a reference recording medium, and executing the recording in the scanning motion of said carrier in one direction only in case of recording on a recording medium of a size larger than said reference size.

3. A serial recording apparatus according to claim 1 or 2, wherein said means for causing the reciprocating scanning motion includes a stepping motor as the drive source for moving said carrier; and said recording apparatus further comprises a driving table for said stepping motor, constituted by an acceleration table of a predetermined number of steps and a deceleration table of a fewer number of steps.

4. A serial recording apparatus according to claim 1 or 2, further comprising means for identifying the necessary recording width of the recording medium.

5. A serial recording apparatus according to claim 2, wherein, even when the size of the recording medium exceeds that of said reference recording medium, the recording is executed in the scanning motions in two directions of said carrier in case the recording data of a line to be recorded do not contain data outside said reference recording width based on the size of said reference recording medium, and the recording is executed in the scanning motion of said carrier in one direction only in case the recording data of a line to be recorded contain data outside said reference recording width.

6. A serial recording apparatus according to claim 1, wherein a comparison of said required recording width and said reference recordable width is executed within the recording apparatus.

7. A serial recording apparatus according to claim 1, wherein a comparison of said required recordable width and said reference recordable width is executed in a host equipment and the one-directional recording or two-directional recording is executed according to the result of said comparison.

* * * * *